US011744428B2

(12) United States Patent
Marutani et al.

(10) Patent No.: US 11,744,428 B2
(45) Date of Patent: Sep. 5, 2023

(54) VACUUM CLEANING APPARATUS

(71) Applicant: TOSHIBA LIFESTYLE PRODUCTS & SERVICES CORPORATION, Kawasaki (JP)

(72) Inventors: Yuuki Marutani, Nagakute (JP); Kota Watanabe, Owariasahi (JP)

(73) Assignee: TOSHIBA LIFESTYLE PRODUCTS & SERVICES CORPORATION, Kawasaki (JP)

( * ) Notice: Subject to any disclaimer, the term of this patent is extended or adjusted under 35 U.S.C. 154(b) by 971 days.

(21) Appl. No.: 16/604,703

(22) PCT Filed: May 22, 2018

(86) PCT No.: PCT/JP2018/019645
§ 371 (c)(1),
(2) Date: Oct. 11, 2019

(87) PCT Pub. No.: WO2018/216687
PCT Pub. Date: Nov. 29, 2018

(65) Prior Publication Data

US 2020/0100640 A1 Apr. 2, 2020

(30) Foreign Application Priority Data

May 23, 2017 (JP) ..... 2017-101945

(51) Int. Cl.
*A47L 11/40* (2006.01)
*A47L 9/00* (2006.01)
(Continued)

(52) U.S. Cl.
CPC ..... *A47L 11/4025* (2013.01); *A47L 9/009* (2013.01); *A47L 9/149* (2013.01); *A47L 9/281* (2013.01);
(Continued)

(58) Field of Classification Search
CPC ..... A47L 11/4025; A47L 9/009; A47L 9/149; A47L 9/281; A47L 9/2873;
(Continued)

(56) References Cited

U.S. PATENT DOCUMENTS 7,891,045 B2 2/2011 Kim et al.
8,742,926 B2 6/2014 Schnittman et al.
(Continued)

FOREIGN PATENT DOCUMENTS

CN 101254080 A 9/2008
CN 201572039 U 9/2010
(Continued)

OTHER PUBLICATIONS

International Search Report dated Jun. 26, 2018 in PCT/JP2018/019645 filed on May 22, 2018.

*Primary Examiner* — David Redding
(74) *Attorney, Agent, or Firm* — Oblon, McClelland, Maier & Neustadt, L.L.P.

(57) ABSTRACT

A vacuum cleaner includes a driving wheel, a cleaning part, a dust-collecting unit, a dust collection amount detection part, and a travel control part. The dust collection amount detection part detects the amount of the dust and dirt accumulated in the dust-collecting unit. The travel control part controls the driving of the driving wheel to make the vacuum cleaner travel autonomously. The travel control part makes the vacuum cleaner travel to a dust station in the case the amount of the dust and dirt detected by the dust collection amount detection part is equal to or more than a specified amount while the cleaning part performs cleaning. The travel control part further makes the vacuum cleaner undock from the dust station to restart the cleaning after the dust and dirt accumulated in the dust-collecting unit is transferred to a dust-collecting container at the dust station.
(Continued)

The vacuum cleaning apparatus can adopt a downsized vacuum cleaner while ensuring convenience.

11 Claims, 6 Drawing Sheets

(51) Int. Cl.
*A47L 9/14* (2006.01)
*A47L 9/28* (2006.01)

(52) U.S. Cl.
CPC ..... *A47L 9/2873* (2013.01); *A47L 11/4011* (2013.01); *A47L 11/4061* (2013.01); *A47L 2201/024* (2013.01); *A47L 2201/04* (2013.01)

(58) Field of Classification Search
CPC ..... A47L 11/4011; A47L 11/4061; A47L 2201/024; A47L 2201/04; A47L 9/19; A47L 9/2852; A47L 2201/022; A47L 9/28
See application file for complete search history.

(56) References Cited

U.S. PATENT DOCUMENTS

| | | | | |
|---|---|---|---|---|
| 9,233,471 | B2 | 1/2016 | Schnittman et al. | |
| 9,402,524 | B2 | 8/2016 | Yoon et al. | |
| 9,788,698 | B2 | 10/2017 | Morin et al. | |
| 9,826,872 | B2 | 11/2017 | Schnittman et al. | |
| 10,022,029 | B2 | 7/2018 | Machida et al. | |
| 10,244,913 | B2 | 4/2019 | Schnittman et al. | |
| 10,405,718 | B2 | 9/2019 | Morin et al. | |
| 10,758,104 | B2 | 9/2020 | Schnittman et al. | |
| 2005/0150074 | A1* | 7/2005 | Diehl | G05D 1/0225 15/327.5 |
| 2008/0201895 | A1 | 8/2008 | Kim et al. | |
| 2012/0169497 | A1 | 7/2012 | Schnittman et al. | |
| 2012/0222224 | A1 | 9/2012 | Yoon et al. | |
| 2012/0291809 | A1 | 11/2012 | Kuhe et al. | |
| 2013/0305481 | A1 | 11/2013 | Jung et al. | |
| 2014/0207282 | A1 | 7/2014 | Angle et al. | |
| 2014/0229008 | A1 | 8/2014 | Schnittman et al. | |
| 2016/0113469 | A1 | 4/2016 | Schnittman et al. | |
| 2016/0278596 | A1* | 9/2016 | Janzen | A47L 11/4066 |
| 2018/0199784 | A1 | 7/2018 | Schnittman et al. | |
| 2019/0212752 | A1* | 7/2019 | Fong | G06V 10/82 |
| 2019/0223679 | A1 | 7/2019 | Schnittman et al. | |

FOREIGN PATENT DOCUMENTS

| | | | |
|---|---|---|---|
| CN | 101992190 | A | 3/2011 |
| CN | 102652654 | A | 9/2012 |
| CN | 103443612 | A | 12/2013 |
| DE | 102004041021 | B3 * | 8/2005 |
| JP | 2006-20830 | A | 1/2006 |
| JP | 2013-146291 | A | 8/2013 |
| JP | 2013-169224 | A | 9/2013 |
| JP | 103315679 | A | 9/2013 |
| JP | 2014-509211 | A | 4/2014 |
| JP | 2014-100318 | A | 6/2014 |
| JP | 2015-66342 | A | 4/2015 |
| JP | 2016-15975 | A | 2/2016 |
| JP | 2016-158189 | A | 10/2016 |
| JP | 2016-185189 | A | 10/2016 |
| KR | 10-0589793 | B1 | 6/2006 |
| KR | 100589793 | B1 * | 6/2006 |
| KR | 10-2009-0053263 | A | 5/2009 |
| WO | WO 2012/092565 | A1 | 7/2012 |
| WO | WO 2016/093911 | A1 | 6/2016 |

* cited by examiner

VACUUM CLEANING APPARATUS

TECHNICAL FIELD

Embodiments described herein relate generally to a vacuum cleaning apparatus including a vacuum cleaner and a station device.

BACKGROUND ART

Conventionally, a so-called autonomously-traveling type vacuum cleaner (a cleaning robot) has been known, which cleans a cleaning-object surface while autonomously traveling on the cleaning-object surface. The vacuum cleaner incorporates a secondary battery as a power source. The vacuum cleaner constitutes a vacuum cleaning system, in combination with a charging table serving as a station device for charging the secondary battery under a standby state such as after the completion of the cleaning.

This type of vacuum cleaner includes a dust-collecting unit for accumulating the dust and dirt collected and caught from a floor surface as the cleaning-object surface. Some of the vacuum cleaners return to the charging table to complete the cleaning, when the amount of the dust and dirt accumulated in the dust-collecting unit reaches a specified amount or more during the cleaning. In this case, it is inconvenient for a user to dispose of the dust and dirt accumulated in the dust-collecting unit every time the cleaning is completed. Accordingly, the vacuum cleaner is preferably configured to store a certain amount of the dust and dirt in the dust-collecting unit, for example, the amount of the dust and dirt accumulated for approximately one week. Therefore, it is not easy to downsize such a vacuum cleaner while ensuring convenience.

In some of the vacuum cleaning apparatuses, the charging table includes a dust-collecting container serving as a dust-collecting storage part to which dust and dirt is transferred. When the vacuum cleaner returns to the charging table after the completion of the cleaning, the dust and dirt accumulated in the dust-collecting unit is transferred to the dust-collecting container. In this case, a user needs not to take time to dispose of the dust and dirt accumulated in the dust-collecting unit of the vacuum cleaner every time, and the convenience thereof is ensured. On the other hand, the timing when the dust and dirt is transferred to the dust-collecting container is the timing of the completion of the cleaning, and thus the vacuum cleaner requires the dust-collecting unit having a large enough size for the amount of the dust and dirt to be accumulated during at least once cleaning. Therefore, a sufficiently-downsized vacuum cleaner is hardly provided.

CITATION LIST

Patent Literature

PTL 1: Patent publication No. 2013-169224
PTL 2: Patent publication No. 2016-15975

SUMMARY OF INVENTION

Technical Problem

The technical problem to be solved by the present invention is to provide a vacuum cleaning apparatus capable of adopting a downsized vacuum cleaner while ensuring convenience.

Solution to Problem

A vacuum cleaning apparatus according to an embodiment has a vacuum cleaner capable of traveling autonomously and a station device including a dust storage part configured to receive and store at least a part of dust and dirt collected and caught by the vacuum cleaner. The vacuum cleaner includes a travel driving part, a cleaning part, a dust-collecting unit, a dust collection amount detector, and a travel controller. The cleaning part performs cleaning to remove dust and dirt. The dust-collecting unit accumulates the dust and dirt removed by the cleaning part. The dust collection amount detector detects an amount of the dust and dirt accumulated in the dust-collecting unit. The travel controller controls driving of the travel driving part so as to make the vacuum cleaner travel autonomously. The travel controller makes the vacuum cleaner travel to the station device in the case where the amount of the dust and dirt detected by the dust collection amount detector is equal to or more than a specified amount while the cleaning part performs the cleaning, and makes the vacuum cleaner undock from the station device to restart the cleaning, after the dust and dirt accumulated in the dust-collecting unit is transferred to the dust storage part at the station device.

DESCRIPTION OF EMBODIMENT

The configuration of the first embodiment is described below with reference to the drawings.

Figure 1:
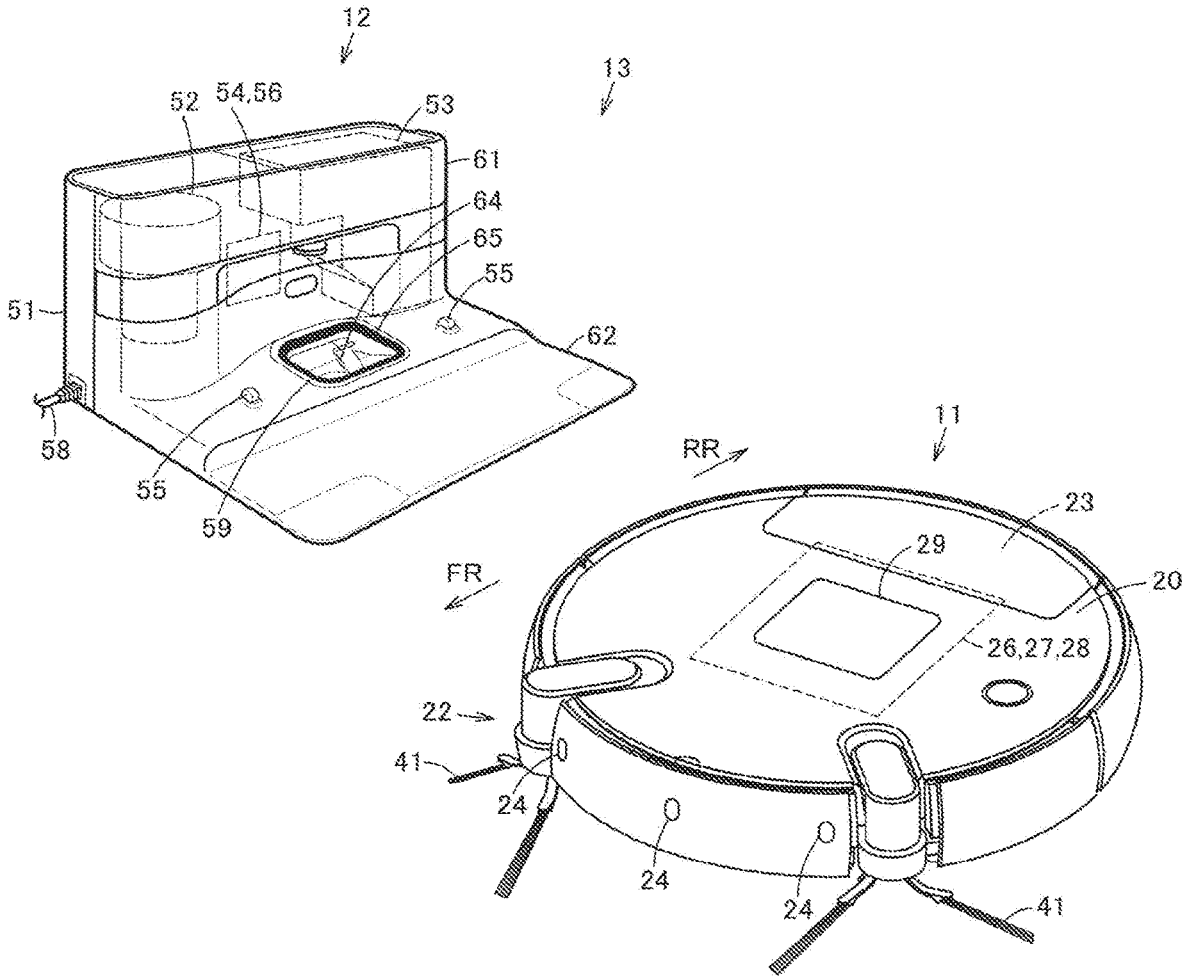
FIG. 1 is a perspective view illustrating a vacuum cleaning apparatus according to a first embodiment.
Figure 2:
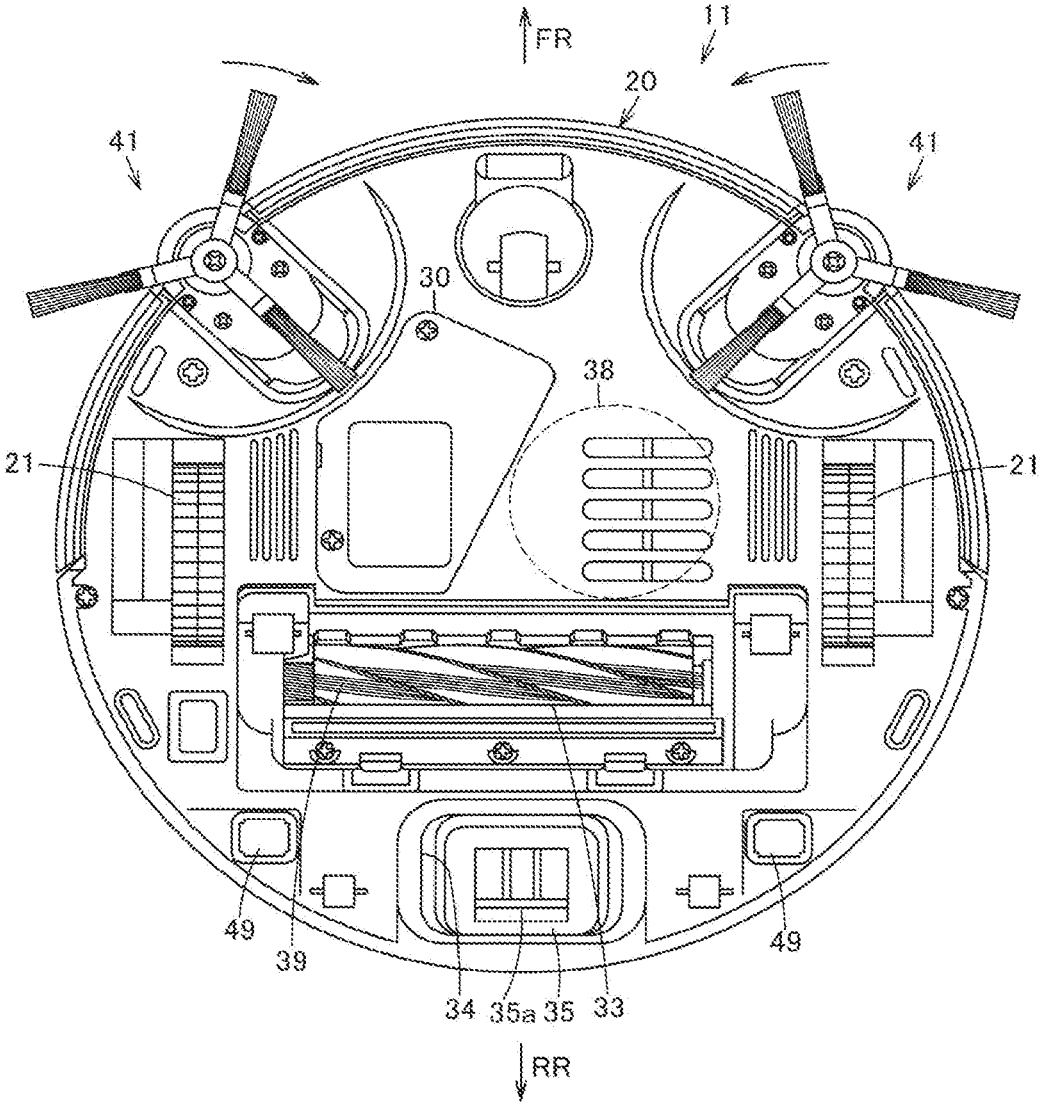
FIG. 2 is a bottom view illustrating a vacuum cleaner of the above vacuum cleaning apparatus.
Figure 3:
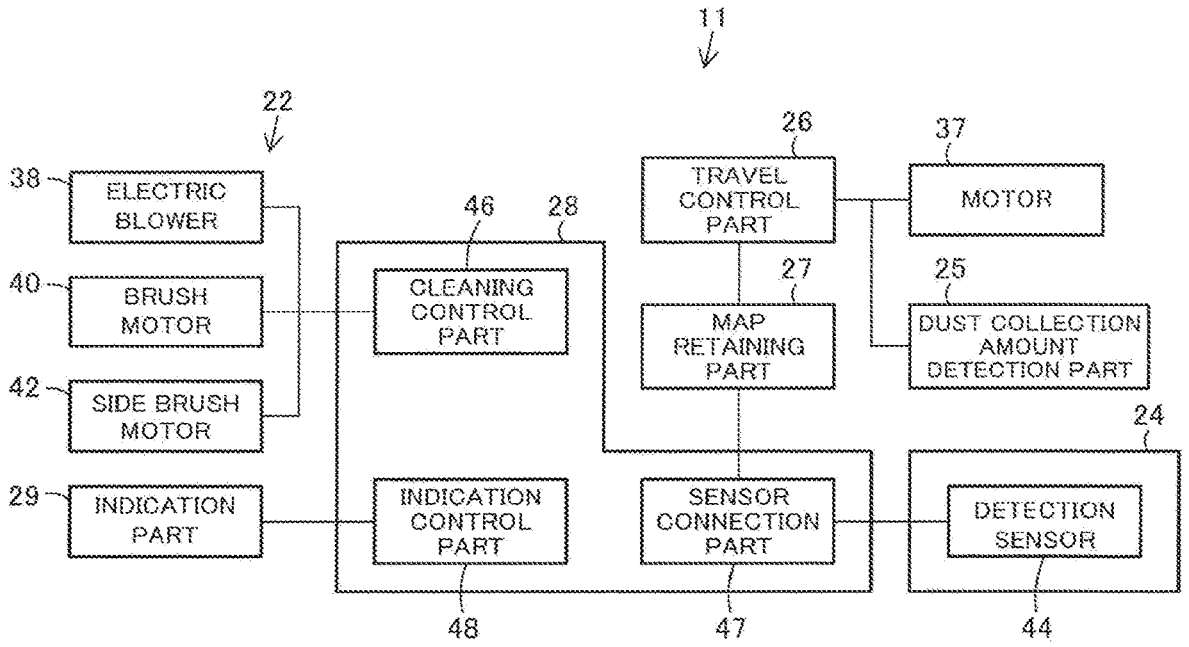
FIG. 3 is a block diagram illustrating the internal structure of the above vacuum cleaner.

In FIG. 1 to FIG. 3, reference sign 11 denotes a vacuum cleaner as an autonomous traveler. The vacuum cleaner 11 constitutes a vacuum cleaning apparatus (a vacuum cleaning system) 13 serving as an autonomous traveler device, in combination with a dust station (a charging table) 12 serving as a station device corresponding to abase part for the vacuum cleaner 11. In the present embodiment, the vacuum cleaner 11 is a so-called self-propelled robot cleaner (a cleaning robot), which cleans a floor surface that is a cleaning-object surface as a traveling surface, while autonomously traveling (self-traveling) on the floor surface.

The vacuum cleaner 11 includes a main casing 20 which is a hollow main body. The vacuum cleaner 11 further includes driving wheels 21 which are travel driving parts. The vacuum cleaner 11 further includes a cleaning unit 22 for removing dust and dirt. The vacuum cleaner 11 further includes a dust-collecting unit 23 for accumulating dust and dirt. The vacuum cleaner 11 further includes a sensor part 24. The vacuum cleaner 11 further includes a dust collection amount detection part 25 serving as dust collection amount detection means. The vacuum cleaner 11 further includes a travel control part 26 serving as travel control means. The vacuum cleaner 11 may further include a map retaining part 27. The vacuum cleaner 11 may further include a control part 28 serving as control means which is a control. The vacuum cleaner 11 may further include an indication part 29 serving as notification means. The vacuum cleaner 11 may further include a secondary battery 30 which is a battery serving as a power source part for power supply. The vacuum cleaner 11 may further include data communication means (a communication part) serving as information transmission means for performing, for example, wired communication or wireless communication via a network. The vacuum cleaner 11 may further include an input/output part for exchanging signals with the dust station 12, an external apparatus or a user. It is noted that the following description will be given on the basis that a direction extending along the traveling direction of the vacuum cleaner 11 (the main casing 20) is treated as a back-and-forth direction (directions of an arrow FR and an arrow RR shown in FIG. 1 and other drawings), while a left-and-right direction (directions toward both sides) intersecting (orthogonally crossing) the back-and-forth direction is treated as a widthwise direction.

The main casing 20 is formed of, for example, synthetic resin. The main casing 20 may be formed into, for example, a flat column (a disk shape). The main casing 20 may have a suction port 33 which is a dust-collecting port. The main casing 20 may further have a dust discharge port 34. Each of the suction port 33 and the dust discharge port 34 may be disposed in the lower part facing the floor surface or other part, of the main casing 20. The dust discharge port 34 may be disposed, for example, in the rearward of the vacuum cleaner 11 (the main casing 20). The dust discharge port 34 is closed by a lid body 35 so as to be openable. The lid body 35 may include a hook groove 35*a* to be used when the dust station 12 opens and closes the lid body 35.

The driving wheels 21 allow the vacuum cleaner 11 (the main casing 20) to travel (autonomously travel) on the floor surface in the advancing direction and the backward direction, that is, serve for traveling use. In the present embodiment, the driving wheels 21 are disposed, for example, on the left and right sides of the main casing 20. The driving wheels 21 are driven by motors 37 serving as driving means (driving control parts). It is noted that a crawler or the like may be used as a travel driving part, instead of these driving wheels 21.

The motors 37 are disposed to correspond to the driving wheels 21. Accordingly, in the present embodiment, a pair of the motors 37 is disposed, for example, on the left and right sides. The motors 37 are capable of independently and respectively driving the driving wheels 21.

The cleaning unit 22 is configured to remove dust and dirt existing on a cleaning-object part, for example, a floor surface and/or a wall surface. In an example, the cleaning unit 22 has the function of collecting and catching dust and dirt existing on a floor surface through the suction port 33, and/or wiping a wall surface. The cleaning unit 22 may include at least one of an electric blower 38 for sucking dust and dirt together with air through the suction port 33, a rotary brush 39 serving as a rotary cleaner rotatably attached to the suction port 33 to scrape up dust and dirt and a brush motor 40 for rotationally driving the rotary brush 39, side brushes 41 which are auxiliary cleaning means (auxiliary cleaning parts) serving as swinging-cleaning parts rotatably attached on the both sides of the main casing 20 on its front side or the like to scrape up dust and dirt and side brush motors 42 for driving the side brushes 41.

The dust-collecting unit 23 is configured to accumulate the dust and dirt collected by the cleaning unit 22, in its inner part. In an example, the dust-collecting unit 23 is provided integrally with the main casing 20, or provided as a device separately from the main casing 20. In the present embodiment, the upstream side of the dust-collecting unit 23 communicates with the suction port 33, while the downstream side thereof communicates with the electric blower 38. The dust-collecting unit 23 further communicates with the dust discharge port 34, separately from the suction port 33. The dust-collecting unit 23 allows the transfer of the dust and dirt accumulated in its inner part to the dust station 12 via the dust discharge port 34.

The sensor part 24 is configured to sense various types of information to be used for supporting the traveling of the vacuum cleaner 11. More specifically, the sensor part 24 is traveling obstacle detection means (a traveling obstacle detection part) for sensing, for example, pits and bumps (a step gap) of the floor surface, a wall which is a traveling obstacle, an obstacle, an amount of the dust and dirt existing on the floor surface, or the like. The sensor part 24 has the function of a feature extraction part of extracting a feature of a cleaning area around the vacuum cleaner 11, and the like. The sensor part 24 includes, for example, a detection sensor 44.

The detection sensor 44 is configured to detect whether or not an object exists, corresponding to a traveling obstacle to the vacuum cleaner 11. In the present embodiment, the detection sensor 44 includes a camera which is image capturing means (an image capturing part). The detection sensor 44 is configured to detect an object (an obstacle) by use of a known technology such as triangulation on the basis of the plurality of images captured by the camera. Alternatively, for example, an infrared sensor utilizing the reflection of an infrared ray or a sensor utilizing a laser beam may be used.

The dust collection amount detection part 25 is configured to detect the amount of the dust and dirt accumulated in the dust-collecting unit 23. In an example, a sensor for indirectly detecting the amount of the dust and dirt accumulated in the dust-collecting unit 23 may serve as the dust collection amount detection part 25, for example, a current sensor for detecting a current value of the electric blower 38, an air volume sensor for detecting an air volume in the suction side of the electric blower 38, or a pressure sensor for detecting a pressure in the suction side of the electric blower 38. In another example, a sensor for directly detecting the amount of the dust and dirt accumulated in the dust-collecting unit 23 may be used, for example, an optical sensor for detecting the height of the dust and dirt accumulated in the dust-collecting unit 23.

The travel control part 26 is configured to control the driving of the motors 37. That is, the travel control part 26 controls the magnitude and direction of the current flowing through each of the motors 37 to rotate each of the motors 37 in a normal or reverse direction, thereby controlling the driving of each of the motors 37. By controlling the driving of each of the motors 37, the travel control part 26 controls the driving of each of the driving wheels 21. The travel control part 26 may be configured to set the optimum traveling route on the basis of the map generated by the map retaining part 27 to be described below. As the optimum traveling route to be generated herein, a route which allows efficient traveling (cleaning) is set, such as the route which allows the shortest traveling distance for traveling in an area possible to be cleaned in the map (an area excluding a part where traveling is impossible due to an obstacle, a step gap or the like), for example, the route by which the vacuum cleaner 11 travels straight as long as possible (where directional change is least required), the route by which contact with an object as an obstacle is less, or the route by which the number of times of redundantly traveling the same location is the minimum, or the like. The travel control part 26 is capable of changing the traveling route as needed, according to the obstacle detected by the sensor part 24 (the detection sensor 44). In an example, the travel control part 26 has a plurality of speed modes for making the vacuum cleaner 11 travel at various speeds which are different from each other, as the traveling mode for driving the driving wheels 21, that is, the motors 37 to make the vacuum cleaner 11 travel autonomously. In an example, in the present embodiment, three types of modes are set, of a high-speed traveling mode, a mid-speed traveling mode and a slow-speed traveling mode. The travel control part 26 monitors the amount of the dust and dirt accumulated in the dust-collecting unit 23 via the dust collection amount detection part 25 during the traveling mode. That is, the travel control part 26 is electrically connected to the dust collection amount detection part 25. In the case where the amount of the dust and dirt in the dust-collecting unit 23 detected by the dust collection amount detection part 25 is equal to or more than a specified amount, the travel control part 26 temporarily interrupts the cleaning and makes the vacuum cleaner 11 return to the dust station 12, and the dust and dirt accumulated in the dust-collecting unit 23 is transferred to the dust station 12. Thereafter, the travel control part 26 performs control so that the vacuum cleaner 11 undocks from the dust station 12 and restarts the cleaning. It is noted that the travel control part 26 may be provided integrally with the control part 28.

The map retaining part 27 is configured to generate and store the map indicating whether or not the vacuum cleaner 11 (the main casing 20) is able to travel in the cleaning area on the basis of the position of the object which is a traveling obstacle existing around the vacuum cleaner 11 (the main casing 20), and is detected by the sensor part 24 (for example, the detection sensor 44). In an example, in the present embodiment, the map retaining part 27 determines the self-position of the vacuum cleaner 11 and whether or not an object as an obstacle exists, on the basis of the three-dimensional coordinates of the feature points of an object in the image captured by the camera of the detection sensor 44. The map retaining part 27 further generates the map indicating the positional relation and the height of an object (an obstacle) and the like positioned in the cleaning area where the vacuum cleaner 11 is arranged. That is, the map retaining part 27 is able to use the known technology of simultaneous localization and mapping (SLAM). The map retaining part 27 is electrically connected to the travel control part 26. It is noted that the map retaining part 27 may be provided integrally with the control part 28.

The control part 28 is a microcomputer including, for example, a CPU which is a control means main body (a control part main body), a ROM, and a RAM. The control part 28 includes a cleaning control part 46 which is cleaning control means electrically connected to the cleaning unit 22. The control part 28 further includes a sensor connection part 47 which is sensor control means electrically connected to the sensor part 24. The control part 28 further includes an indication control part 48 which serves as indication control means electrically connected to the indication part 29. That is, the control part 28 is electrically connected to the cleaning unit 22, the sensor part 24, the indication part 29 and the like. The control part 28 is further electrically connected to the secondary battery 30. It is noted that the control part 28 may include a non-volatile memory, for example, a flash memory. The control part 28 may further include a charging control part for controlling the charging of the secondary battery 30.

The cleaning control part 46 controls the driving of the electric blower 38, the brush motor 40 and the side brush motors 42 of the cleaning unit 22. That is, the cleaning control part 46 individually controls the current-carrying quantities of the electric blower 38, the brush motor 40 and the side brush motors 42, thereby controlling the driving of the electric blower 38, the brush motor 40 (the rotary brush 39) and the side brush motors 42 (the side brushes 41).

The sensor connection part 47 is configured to acquire the detection result by the sensor part 24 (the detection sensor 44). The sensor connection part 47 may include the function of the camera control part for controlling, for example, the operation of the camera (the operation of the shutter of the camera or the like) of the detection sensor 44, thereby making the camera capture images at a specified time interval.

The indication control part 48 performs control to indicate various types of information on the indication part 29. In an example, the indication control part 48 is capable of indicating, on the indication part 29, an elapsed time from cleaning start, remaining time of cleaning, scheduled time of cleaning end, or the like. The indication control part 48 is further capable of indicating and reporting the status of the vacuum cleaner 11. In an example, the indication control part 48 is capable of indicating, on the indication part 29, at least one of the state of the vacuum cleaner 11 under standby, the state of the secondary battery 30 under charging, the state of the vacuum cleaner 11 under temporal returning to the dust station 12, the state where dust and dirt is being transferred from the dust-collecting unit 23 to the dust station 12.

For example, an LED or a liquid crystal display (LCD) serves as the indication part 29. The indication part 29 is disposed at a position visible to a user from above the vacuum cleaner 11. The indication part 29 is disposed, for example, on the upper face of the main casing 20. The indication part 29 may include input means, for example, a touch panel.

The secondary battery 30 is configured to supply electric power to the cleaning unit 22, the sensor part 24, the dust collection amount detection part 25, the travel control part 26, the map retaining part 27, the control part 28, the indication part 29 and the like. The secondary battery 30 is electrically connected to charging terminals 49 serving as connection parts exposed and disposed on the lower parts of the main casing 20, as an example. The charging terminals 49 are to be electrically and mechanically connected to the dust station 12, whereby the secondary battery 30 is charged via the dust station 12.

The input/output part is configured to acquire a control command transmitted by an external apparatus such as a remote control not shown, and/or a control command input through input means such as a switch or a touch panel disposed on the main casing 20, and also exchange signals with, for example, the dust station 12. In an example, the input/output part may include transmission means (a transmission part) not shown, such as an infrared light emitting element for transmitting wireless signals (infrared signals) to the dust station 12 and the like. The input/output part may further include reception means (a reception part) not shown such as a phototransistor for receiving wireless signals (infrared signals) from the dust station 12, a remote control or the like, and other means.

Figure 4:
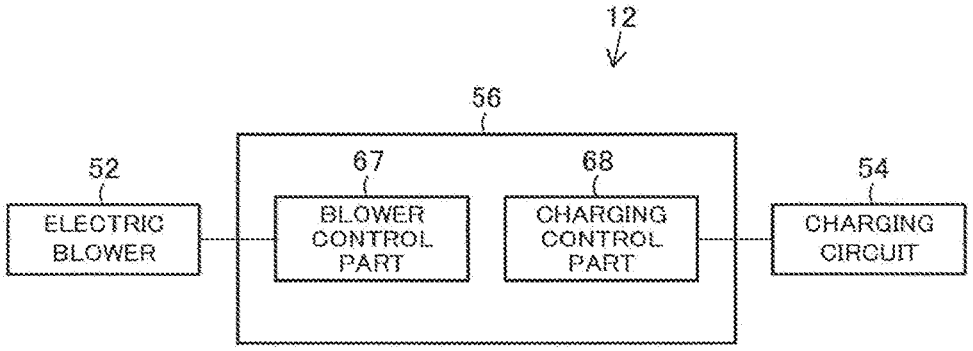
FIG. 4 is a block diagram illustrating the internal structure of a station device of the above vacuum cleaning apparatus.

On the other hand, the dust station 12 shown in FIG. 1, FIG. 4 and the like is disposed in the cleaning area and the like, and includes the function of transferring the dust and dirt accumulated in the dust-collecting unit 23 of the vacuum cleaner 11. The dust station 12 includes a casing body 51 which is a station device casing body. The dust station 12 may include an electric blower 52 which is a transfer force generator serving as transfer means (a transfer part). The dust station 12 further includes a dust-collecting container 53 serving as a dust storage part. The dust station 12 may further include the function of charging the secondary battery 30 (FIG. 2) of the vacuum cleaner 11. In this case, the dust station 12 may incorporate a charging circuit 54, for example, a constant current circuit. The dust station 12 may further include terminals for charging 55 to be used for charging the secondary battery 30 (FIG. 2) of the vacuum cleaner 11. The dust station 12 includes a station control part 56 serving as station control means which is a station device control. The dust station 12 may further include a power code 58 which is a station power source for taking power from an external power source not shown, such as a commercial AC power source. In addition, the dust station 12 may be configured to output, for example, a guide signal (beacon) for guiding the vacuum cleaner 11. In this case, the dust station 12 may further include a transmission/reception part for exchanging signals such as guide signals with the input/output part of the vacuum cleaner 11 or the like.

In the description below, the state in which the vacuum cleaner 11 is connected to the dust station 12 refers to the state in which, when the vacuum cleaner 11 is at a specified position with respect to the dust station 12, the dust discharge port 34 (FIG. 2) and a dust suction port 59 to be described below are connected in an airtight manner, and thereby dust and dirt is enabled to be transferred from the vacuum cleaner 11 (the dust-collecting unit 23) to the dust station 12 (the dust-collecting container 53).

The casing body 51 is formed of, for example, synthetic resin. The casing body 51 includes a body portion 61. The casing body 51 includes a placing part 62.

The body portion 61 incorporates the electric blower 52, the dust-collecting container 53, the charging circuit 54, the transmission/reception part, the station control part 56, and the like. In an example, the body portion 61 is disposed so as to stand upward.

The placing part 62 has a plate shape extending along the floor surface. The driving wheels 21 of the vacuum cleaner 11 directly run up onto the placing part 62. The placing part 62 has an opening as the dust suction port 59. The placing part 62 further has a hook part 64 serving as a lid body opening/closing part for opening and closing the lid body 35.

The dust suction port 59 is configured to communicate with the dust-collecting container 53, and further so as to communicate with the dust discharge port 34 (FIG. 2) of the vacuum cleaner 11 under the state where the vacuum cleaner 11 is connected to the dust station 12. The dust suction port 59 may be formed in, for example, a square shape. A seal member 65 may be attached on the outer edge of the dust suction port 59 so that the dust suction port 59 and the dust discharge port 34 (FIG. 2) are connected in an airtight manner. The hook part 64 is disposed inside the dust suction port 59. The dust suction port 59 is further connected to the dust-collecting container 53 via a duct part not shown in an airtight manner.

The seal member 65 is a packing for stopping air leakage under the state where the dust discharge port 34 (FIG. 2) and the dust suction port 59 are connected. The seal member 65 is configured with, for example, a rubber member or an elastomer member.

The hook part 64 is configured to open and close the lid body 35 (FIG. 2) in accompany with docking and undocking of the vacuum cleaner 11 with respect to the dust station 12. The hook part 64 is supported about an axis so as to be rotatable with respect to the casing body 51. The tip of the hook part 64 is inserted into the hook groove 35*a* (FIG. 2) of the lid body 35 as the vacuum cleaner 11 approaches the dust station 12. When the vacuum cleaner 11 further approaches the dust station 12, the hook part 64 is pressed by the vacuum cleaner 11 and thereby rotated downward. The hook part 64 opens the lid body 35 (FIG. 2) downward before the terminals for charging 55 are brought into contact with the charging terminals 49 (FIG. 2).

The electric blower 52 is configured to suck dust and dirt together with air through the dust suction port 59 into the dust-collecting container 53, and further discharge the air after the contained dust and dirt is caught, through an exhaust port not shown disposed in the casing body 51.

The dust-collecting container 53 is a dust-collecting box for receiving and storing the dust and dirt which has been accumulated in the dust-collecting unit 23 of the vacuum cleaner 11, in its inner part. The dust-collecting container 53 may be attachable and detachable with respect to the casing body 51. The dust-collecting container 53 has an opening serving as a communication opening not shown for communicating with the dust suction port 59 (via a duct part). The dust-collecting container 53 has another opening serving as an exhaust opening not shown, which is formed, separately from the communication opening, along the back-and-forth direction to communicate with the suction side of the electric blower 52. That is, the upstream side of the dust-collecting container 53 communicates with the dust suction port 59, while the downstream side of the dust-collecting container 53 communicates with the electric blower 52. The dust-collecting container 53 is configured to accumulate the dust and dirt sucked together with air through the dust suction port 59 by the driving of the electric blower 52, in its inner part. The dust-collecting container 53 may incorporate a filter body not shown, which prevents the dust and dirt contained in the air passing through the dust-collecting container 53 from being sucked into the electric blower 52, or may be configured to centrifuge the dust and dirt (perform cyclone separation).

A known circuit, for example, a constant current circuit may serve as the charging circuit 54. The charging circuit 54 may be provided integrally with the station control part 56.

The terminals for charging 55 are electrically connected to the charging circuit 54. For example, a pair of the terminals for charging 55 is configured on, for example, the placing part 62 of the casing body 51. The terminals for charging 55 are configured to be mechanically and electrically connected to the charging terminals 49 of the vacuum cleaner 11 when returning to the dust station 12.

The station control part 56 is, for example, a microcomputer configured to control the operation of the electric blower 52, the transmission/reception part, the charging circuit 54 and the like, respectively. The station control part 56 may include a blower control part 67 for controlling the driving of the electric blower 52. The station control part 56 may include a charging control part 68 for controlling the driving of the charging circuit 54.

The power code 58 is configured to take power from an external power source to the electric blower 52, the charging circuit 54, the station control part 56 and the like, when the power code 58 is connected to an electrical outlet disposed on, for example, a wall surface.

The external apparatus is a general-purpose device, for example, a PC (a tablet terminal (a tablet PC)) or a smartphone (a mobile phone), which is capable of, inside a building, performing wired or wireless communication with the network via, for example, a home gateway, and outside a building, performing wired or wireless communication with the network. The external apparatus may have a display function of displaying at least an image.

The operation of the above-described first embodiment is described below with reference to the drawings.

In general, the vacuum cleaning apparatus 13 includes cleaning work for carrying out cleaning by the vacuum cleaner 11, and transfer work for transferring the dust and dirt accumulated in the dust-collecting unit 23 of the vacuum cleaner 11 to the dust-collecting container 53 of the dust station 12. In the case where the power source of the vacuum cleaner 11 is the secondary battery 30, the vacuum cleaning apparatus 13 further includes charging work.

The outline from the start to the end of the cleaning in the cleaning work is described first. In the case where the map retaining part 27 does not retain any map, the vacuum cleaner 11 performs map generation operation in advance after starting the cleaning, as an example, and the travel control part 26 sets a traveling route on the basis of the generated map. While in the case where the map retaining part 27 retains a map, the travel control part 26 sets a traveling route on the basis of the retained map. The vacuum cleaner 11 then performs the cleaning while traveling along the set traveling route.

In the case where a specified amount or more of the dust and dirt is accumulated in the dust-collecting unit 23 during the cleaning, the vacuum cleaner 11 temporarily interrupts the cleaning, and moves to the dust station 12 to transfer the dust and dirt accumulated in the dust-collecting unit 23 to the dust-collecting container 53, and thereafter undocks from the dust station 12 to restart the cleaning.

The vacuum cleaner 11 returns to the dust station 12 after completing the cleaning. Thereafter, the vacuum cleaner 11 is switched over to the transfer work for transferring the dust and dirt accumulated in the dust-collecting unit 23 to the dust-collecting container 53 at arbitrary timing. In the case where the dust station 12 includes the function of charging the secondary battery 30, the dust station 12 is switched over to the charging work for charging the secondary battery 30 at arbitrary timing.

The above-described control is described below more specifically. The vacuum cleaner 11 starts the operation at certain timing, for example, the timing when a preset cleaning start time arrives, or the timing when the input/output part receives the control command to start cleaning transmitted by a control or an external apparatus. The cleaning may start from the position of the dust station 12, or another position different from the dust station 12.

The next description is about the map generation operation of the case where the map retaining part 27 does not retain any map. In an example, the travel control part 26 controls the driving of the driving wheels 21 (the motors 37) to make the vacuum cleaner 11 autonomously travel in the cleaning area at random or according to a specified rule. Then, the map retaining part 27 generates a map on the basis of the traveling obstacle existing around the vacuum cleaner 11 detected by the sensor part 24 (the detection sensor 44), while checking the self-position of the vacuum cleaner 11.

The travel control part 26 sets the traveling route on the basis of the generated map or the map retained in advance in the map retaining part 27. The travel control part 26 controls the driving of the driving wheels 21 (the motors 37) so that the vacuum cleaner 11 autonomously travels along the traveling route. The cleaning control part 46 operates the cleaning unit 22 so that the cleaning unit 22 cleans the floor surface in the cleaning area. In an example, the electric blower 38, the brush motor 40 (the rotary brush 39) or the side brush motors 42 (the side brushes 41) of the cleaning unit 22 is driven by the control part 28 (the cleaning control part 46) to collect and catch the dust and dirt existing on the floor surface into the dust-collecting unit 23 through the suction port 33.

The travel control part 26 during the traveling (the cleaning) monitors the amount of the dust and dirt accumulated in the dust-collecting unit 23, via the dust collection amount detection part 25. The amount of the dust and dirt is compared with the threshold value stored in advance. In the case where the amount of the dust and dirt is equal to or more than the threshold value, the amount of the dust and dirt equal to or more than the specified amount is determined to have been accumulated in the dust-collecting unit 23 (it is determined that the dust-collecting unit 23 is filled with dust and dirt). In order that the dust and dirt accumulated in the dust-collecting unit 23 is transferred to the dust station 12, the travel control part 26 controls the driving of the driving wheels 21 (the motors 37) so that the vacuum cleaner 11 temporarily returns to the dust station 12. In this case, the map retaining part 27 may retain (mark) the position of the map corresponding to the position at which the amount of the dust and dirt has been determined to be equal to or more than the specified amount.

As for the returning to the dust station 12, the travel control part 26 controls the driving of the driving wheels 21 (the motors 37) so that the vacuum cleaner 11 travels toward the dust station 12 according to the map retained in the map retaining part 27. In an example, in the case where the position of the dust station 12 is not indicated on the map, signals are exchanged with the dust station 12, whereby the travel control part 26 controls the driving of the driving wheels 21 (the motors 37) so that the vacuum cleaner 11 approaches the dust station 12. In the case where the vacuum cleaner 11 temporarily interrupts the cleaning and travels toward the dust station 12 as described above, the control part 28 (the cleaning control part 46) preferably stops the cleaning unit 22. The travel control part 26 preferably increases the traveling speed of the vacuum cleaner 11 as compared to the normal traveling speed. In an example, the travel control part 26 preferably switches the traveling mode to the high-speed traveling mode in which the traveling speed is higher the normal traveling mode (the mid-speed traveling mode). In the case where the amount of the dust and dirt detected by the dust collection amount detection part 25 is equal to or more than a specified amount and thus the travel control part 26 makes the vacuum cleaner 11 travel toward the dust station 12 as described above, the indication part 29 preferably indicates that the vacuum cleaner 11 is under temporarily returning to the dust station 12 in order to transfer the dust and dirt accumulated in the dust-collecting unit 23 to the dust-collecting container 53 of the dust station 12.

Figure 5:
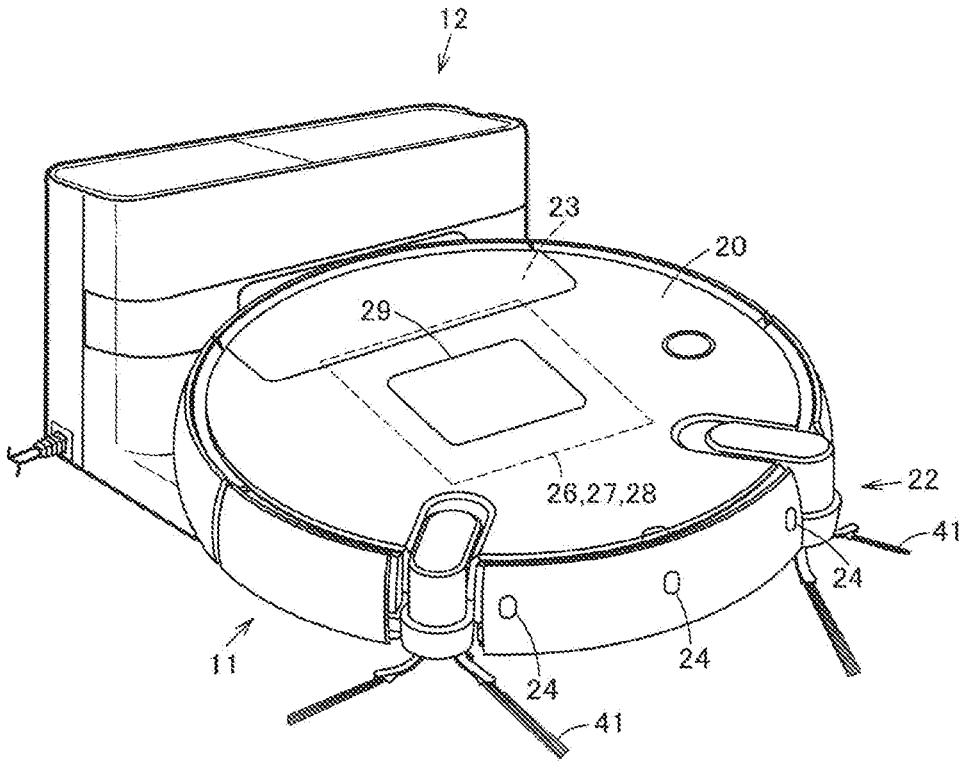
FIG. 5 is a perspective view illustrating the state where the above vacuum cleaner is connected to the station device.

When returning to the dust station 12, the vacuum cleaner 11 docks with the dust station 12 (FIG. 5). At this time, in an example, the travel control part 26 of the vacuum cleaner 11 controls the driving of the driving wheels 21 (the motors 37) to make the vacuum cleaner 11 turn so that the rear part of the vacuum cleaner 11, that is, the side of the dust-collecting unit 23 faces the dust station 12, and thereafter to make the vacuum cleaner 11 move backward and approach the dust station 12. When the vacuum cleaner 11 further moves backward under the state where the driving wheels 21 runs up onto the placing part 62, the hook part 64 is inserted into the hook groove 35*a* of the lid body 35 disposed on the rear side of the lower part of the vacuum cleaner 11 (the main casing 20). As the vacuum cleaner 11 further moves backward under the state, the hook part 64 rotates downward, thereby rotating the lid body 35 downward. Thereafter, when the vacuum cleaner 11 moves backward to the rearmost position, the dust discharge port 34 exposed by the opened lid body 35 and the dust suction port 59 are connected in an airtight manner, so that they face with each other in the up-and-down direction. The charging terminals 49 are mechanically and electrically connected to the terminals for charging 55 of the dust station 12. Under the state, the travel control part 26 temporarily stops the driving of the driving wheels 21 (the motors 37), whereby the vacuum cleaner 11 stops the moving backward.

Under the state where the vacuum cleaner 11 is connected to the dust station 12, for example, the station control part 56 (the blower control part 67) of the dust station 12 makes the electric blower 52 operate, for example, for a specified period of time, thereby transferring the dust and dirt accumulated in the dust-collecting unit 23 to the dust-collecting container 53 via the dust discharge port 34 and the dust suction port 59 (transfer work). After the completion of the transferring of the dust and dirt, the station control part 56 (the blower control part 67) stops the electric blower 52.

Thereafter, in the case where the battery capacity of the secondary battery 30 is insufficient for the restart of the cleaning when the vacuum cleaner 11 restarts the cleaning, the station control part 56 (the charging control part 68) may charge the secondary battery 30 via the charging circuit 54. On the other hand, in the case where the battery capacity of the secondary battery 30 is not insufficient, the travel control part 26 controls the driving of the driving wheels 21 (the motors 37) so that the vacuum cleaner 11 undocks from the dust station 12, without the charging of the secondary battery 30.

Figure 6A:
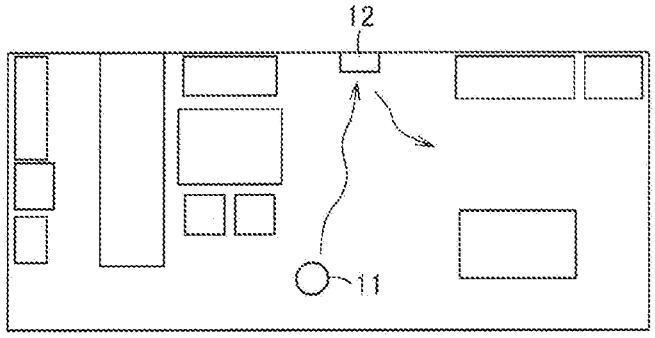
FIG. 6A is an explanatory view schematically illustrating one example of the operation in which the above vacuum cleaner travels to the station device to transfer dust and dirt, and thereafter undocks from the station device to restart the cleaning.
Figure 6B:
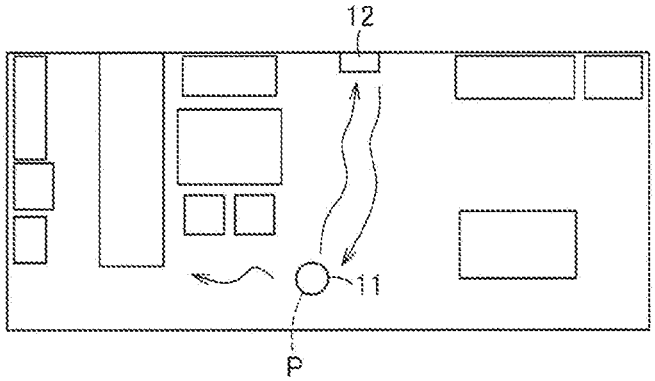
FIG. 6B is an explanatory view schematically illustrating another example of the operation in which the above vacuum cleaner travels to the station device to transfer dust and dirt, and thereafter undocks from the station device to restart the cleaning.

At for the undocking, the vacuum cleaner 11 may undock from the dust station 12 simply to an arbitrary position, and may restart the cleaning from the position (FIG. 6A). Alternatively, in the case where a position P at which the amount of the dust and dirt in the dust-collecting unit 23 has been determined to be equal to or more than a specified amount, that is, at which the cleaning has been interrupted temporarily, is retained in the map retaining part 27, the vacuum cleaner 11 may go back to the position P at which the cleaning has been interrupted temporarily on the basis of the map, to restart the cleaning (FIG. 6B).

It is noted that whether or not the cleaning unit 22 operates while the vacuum cleaner 11 travels from the position of the dust station 12 to the position P at which the cleaning has been interrupted temporarily may be set in accordance with the progress of the cleaning in the cleaning area. In an example, in the case where the cleaning has not been performed yet on the floor surface between the dust station 12 and the position P at which the cleaning has been interrupted temporarily, the control part 28 (the cleaning control part 46) may make the cleaning unit 22 operate to perform cleaning. In the case where the cleaning has been performed, the control part 28 (the cleaning control part 46) may stop the cleaning unit 22 (may keep the cleaning unit 22 under the stoppage state). In the case where the travel control part 26 makes the vacuum cleaner 11 travel while keeping the cleaning unit 22 under the stoppage state, to the position P at which the cleaning has been interrupted temporarily, the travel control part 26 preferably increases the traveling speed of the vacuum cleaner 11, as compared to the normal traveling speed. In an example, the travel control part 26 preferably switches the traveling mode to the high-speed traveling mode in which the traveling speed is higher than the normal traveling speed (the mid-speed traveling mode). In addition, in the case where the travel control part 26 makes the vacuum cleaner 11 travel from the position of the dust station 12 to the position at which the amount of the dust and dirt in the dust-collecting unit 23 has been determined to be equal to or more than a specified amount, that is, the position P at which the cleaning has been interrupted temporarily, the indication part 29 preferably indicates that the vacuum cleaner 11 is traveling in order to restart the cleaning after having transferred the dust and dirt accumulated in the dust-collecting unit 23 to the dust station 12.

The vacuum cleaner 11 completes the cleaning work when completing the traveling in the cleaning area, and the travel control part 26 controls the driving of the driving wheels 21 (the motors 37) so that the vacuum cleaner 11 returns to the dust station 12 and docks with the dust station 12. The docking operation is identical to the operation described above, and thus the description thereof will be omitted. When the vacuum cleaner 11 is connected to the dust station 12, the vacuum cleaning apparatus 13 is switched over to the transfer work or the charging work at specified timing, such as after a specified period of time. The transfer work is identical to the work described above, and thus the description thereof will be omitted. It is noted that the transfer work is not essential, even though the transfer work allows the start of the next cleaning from the state where the dust-collecting unit 23 is empty and thus the electric blower 38 is able to efficiently suck dust and dirt. In other word, in the case where the amount of the dust and dirt accumulated in the dust-collecting unit 23 is equal to or more than a specified amount even during the cleaning, the vacuum cleaner 11 returns to the dust station 12 to transfer the dust and dirt to the dust-collecting container 53. Accordingly the dust and dirt accumulated in the dust-collecting unit 23 is not necessarily transferred to the dust-collecting container 53 every time when the vacuum cleaner 11 returns to the dust station 12 after the completion of the cleaning. In an example, the dust and dirt may be transferred for every plural times of the returning, or may be transferred only when the amount of the dust and dirt accumulated in the dust-collecting unit 23 is equal to or more than a previously-set specified amount. The charging work is not indispensable. In an example, in the case where the secondary battery 30 still has a sufficient remaining capacity, the charging may not be performed.

As described above, according to the first embodiment, the travel control part 26 makes the vacuum cleaner 11 travel to the dust station 12 on the basis of the map retained by the map retaining part 27 of the vacuum cleaner 11. Accordingly, the usage of the function of the map retaining part 27 enables to make the vacuum cleaner 11 travel smoothly and efficiently to the dust station 12.

Similarly, the travel control part 26 makes the vacuum cleaner 11 travel to the position P at which the amount of the dust and dirt accumulated in the dust-collecting unit 23 has been determined to be equal to or more than the specified amount, on the basis of the map retained by the map retaining part 27 of the vacuum cleaner 11. Accordingly, the usage of the function of the map retaining part 27 enables to make the vacuum cleaner 11 travel smoothly and efficiently to the position P.

Accordingly, in the case of the vacuum cleaner 11 using the secondary battery 30 as the power source thereof, the consumption of the battery capacity in the secondary battery 30 is able to be reduced when the vacuum cleaner 11 travels to the dust station 12 or to the position P. Therefore, in an example, the vacuum cleaner 11 may be configured with the secondary battery 30 having a smaller capacity, that is, with the secondary battery 30 which is lighter in weight and smaller in size, whereby the vacuum cleaner 11 is made smaller and lighter. The vacuum cleaner 11 having such a configuration is able to operate for a longer period of time. Alternatively, the vacuum cleaner 11 adopting the secondary battery 30 similar to the conventional one is able to operate for a further longer period of time than the conventional one.

It is noted that, in the first embodiment described above, the map retaining part 27 may simply retain (store) the map of the cleaning area input through an external apparatus or the like or the map of the cleaning area previously set, without generating the map.

Figure 7:
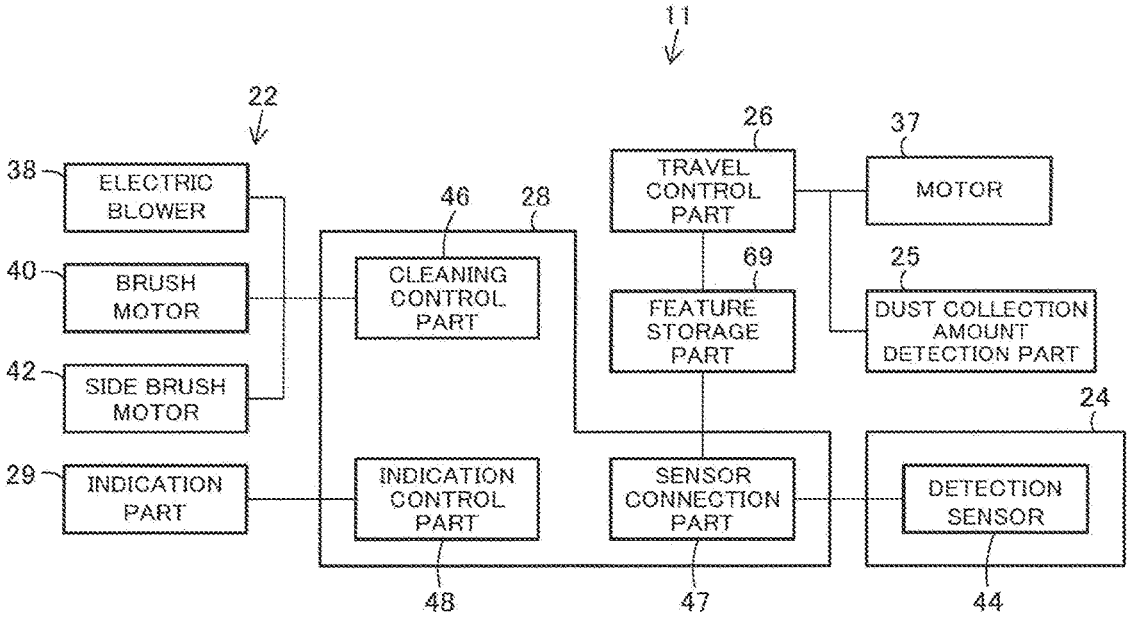
FIG. 7 is a block diagram illustrating the internal structure of a vacuum cleaner of a vacuum cleaning apparatus according to a second embodiment.

The second embodiment is described below with reference to FIG. 7. It is noted that the same reference signs are assigned to the configurations and the effects identical to those of the first embodiment described above, and thus the description thereof will be omitted.

In the second embodiment, the vacuum cleaner 11 includes a feature storage part 69, instead of the map retaining part 27 in the above-described first embodiment.

The feature storage part 69 is a memory for storing the feature of the cleaning area of, for example, the surrounding of the vacuum cleaner 11 (the main casing 20) detected by the sensor part 24 (for example, the detection sensor 44). The feature of the cleaning area herein corresponds to, for example, the shape feature of the object positioned in the surrounding area of the vacuum cleaner 11. In an example, the feature is able to be detected as an edge or a line in the image captured by the camera of the detection sensor 44 of the sensor part 24. The feature storage part 69 is electrically connected to the travel control part 26. It is noted that the feature storage part 69 may be provided integrally with the control part 28.

The dust station 12 may be configured to output, for example, a guide signal (beacon) for guiding the vacuum cleaner 11. In this case, the dust station 12 may further include a transmission/reception part for exchanging signals such as guide signals with the input/output part of the vacuum cleaner 11 or the like.

The outline from the start to the end of the cleaning in the cleaning work is described below. After starting the cleaning, the vacuum cleaner 11 travels and performs the cleaning while avoiding the traveling obstacle detected by the sensor part 24 (the detection sensor 44), for example, at random or according to a specified rule.

At this time, in the case where the amount of the dust and dirt accumulated in the dust-collecting unit 23 is equal to or more than a specified amount during the cleaning, the vacuum cleaner 11 temporarily interrupts the cleaning, and travels to the dust station 12 to transfer the dust and dirt accumulated in the dust-collecting unit 23 to the dust-collecting container 53. Thereafter, the vacuum cleaner 11 undocks from the dust station 12 to restart the cleaning.

After the completion of the cleaning, the vacuum cleaner 11 returns to the dust station 12. Thereafter, the vacuum cleaner 11 is switched over to the transfer work for transferring the dust and dirt accumulated in the dust-collecting unit 23 to the dust-collecting container 53 at arbitrary timing. In the case where the dust station 12 includes the function of charging the secondary battery 30, the dust station 12 is switched over to the charging work for charging the secondary battery 30 at arbitrary timing.

The above control different from the one in the first embodiment described above is described below specifically. After the start of the cleaning, the travel control part 26 controls the driving of the driving wheels 21 (the motors 37), so that the vacuum cleaner 11 travels while avoiding the traveling obstacle detected by the sensor part 24 (the detection sensor 40) along, for example, the traveling route previously set or the traveling route input by a user, or alternatively so that the vacuum cleaner travels while simply avoiding the traveling obstacle detected by the sensor part 24 (the detection sensor 44) at random or according to a specified rule, without the setting of the traveling route.

In the case where the amount of the dust and dirt in the dust-collecting unit 23 monitored via the dust collection amount detection part 25 is equal to or more than a specified amount, the travel control part 26 controls the driving of the driving wheels 21 (the motors 37) so that the vacuum cleaner 11 temporarily returns to the dust station 12 to transfer the dust and dirt accumulated in the dust-collecting unit 23 to the dust station 12. At this time, for example, the sensor part 24 (the detection sensor 44) detects the feature of the cleaning area, such as the surrounding of the position P on the map corresponding to the position at which the amount of the dust and dirt has been determined to be equal to or more than the specified amount, and the feature storage part 69 stores the feature.

When the vacuum cleaner 11 returns to the dust station 12, the travel control part 26 controls the driving of the driving wheels 21 (the motors 37) so that the vacuum cleaner 11 travels and approaches the dust station 12 by, for example, exchanging signals with the dust station 12.

When the vacuum cleaner 11 undocks from the dust station 12 after the completion of transfer of the dust and dirt, the vacuum cleaner 11 may simply undock and travel to an arbitrary position from the dust station 12 to restart the cleaning from the position. Alternatively, the vacuum cleaner 11 may search, on the basis of the feature stored in the feature storage part 69, of the position P at which the amount of the dust and dirt accumulated in the dust-collecting unit 23 has been determined to be equal to or more than the specified amount, and may return to the position P to restart the cleaning. It is noted that while the vacuum cleaner 11 returns to the position P, the operation of the cleaning unit 22 is stopped preferably.

As described above, according to the second embodiment, when the amount of the dust and dirt detected by the dust collection amount detection part 25 is equal to or more than a specified amount and when the travel control part 26 performs control to make the vacuum cleaner 11 travel to the dust station 12, the feature storage part 69 stores the feature of the position P at which the amount of the dust and dirt has been determined to be equal to or more than the specified amount. The travel control part 26 makes the vacuum cleaner 11 travel to the position P at which the amount of the dust and dirt accumulated in the dust-collecting unit 23 has been determined to be equal to or more than the specified amount, on the basis of the stored feature, thereby enabling to make the vacuum cleaner 11 travel smoothly and efficiently to the position P.

The map of the cleaning area needs not to be retained, and thus the configuration for retaining (storing) the map or the like is not required. Accordingly, a simpler configuration is achieved.

It is noted that, in each of the embodiments described above, the dust station 12 may not include the function of charging the secondary battery 30 of the vacuum cleaner 11. In this case, the vacuum cleaning apparatus 13 may include, for example, a separate charging apparatus for charging the secondary battery 30.

In addition, a sound generator using sound may serve as notification means, or alternatively such a sound generator may be used in combination with the indication part 29.

The dust and dirt is transferred from the dust-collecting unit 23 of the vacuum cleaner 11 to the dust-collecting container 53 of the dust station 12 by a transfer force generator (the electric blower 52) included in the dust station 12. Alternatively, in another example of the configuration, the dust and dirt may be blown out from the dust-collecting unit 23 of the vacuum cleaner 11 to the dust-collecting container 53 of the dust station 12. That is, the configuration for transferring the dust and dirt from the dust-collecting unit 23 of the vacuum cleaner 11 to the dust-collecting container 53 of the dust station 12 may be included in the vacuum cleaner 11 or in the dust station 12. The present invention is not limited to the configurations of the embodiments described above.

In another configuration, the vacuum cleaner 11 may use an external power source such as a commercial power source, instead of the secondary battery 30.

Further in another example, the cleaning unit 22 may be configured so that the rotary brush 39 scrapes up the dust and dirt from the cleaning-object surface and accumulates the dust and dirt into the dust-collecting unit 23, without the inclusion of the electric blower 38.

The vacuum cleaner 11 may include neither the map retaining part 27 nor the feature storage part 69. In this case, the vacuum cleaner 11 may search the position of the dust station 12 on the basis of the detection by the sensor part 24 (the detection sensor 44) or the like, the position P at which the amount of the dust and dirt accumulated in the dust-collecting unit 23 has been determined to be equal to or more than a specified amount, or other position.

According to at least one of the embodiments described above, in the case where the amount of the dust and dirt in the dust-collecting unit 23 detected by the dust collection amount detection part 25 during the cleaning is equal to or more than a specified amount, the travel control part 26 controls the driving of the driving wheels 21 so as to make the vacuum cleaner 11 travel to the dust station 12. After the vacuum cleaner 11 transfers the dust and dirt accumulated in the dust-collecting unit 23 to the dust-collecting container 53 at the dust station 12, the travel control part 26 makes the vacuum cleaner 11 undock from the dust station 12 to restart the cleaning. Therefore, even though the vacuum cleaner 11 includes the dust-collecting unit 23 not having a large size, or even though a user disposes of the dust and dirt accumulated in the dust-collecting unit 23 not every time, the vacuum cleaner 11 is capable of efficiently and surely perform the cleaning. In this case, in an example, the dust-collecting unit 23 of the vacuum cleaner 11 may have an insufficient size for the estimated amount of the dust and dirt to be accumulated during once cleaning. As a result, the vacuum cleaner 11 is enabled to be downsized, while ensuring convenience.

As the amount of the dust and dirt increases in the dust-collecting unit 23, the suction force by the electric blower 38 is lowered in the vacuum cleaner 11. Therefore, the transfer of the dust and dirt accumulated in the dust-collecting unit 23 to the dust-collecting container 53 of the dust station 12 enables to recover the suction force of the electric blower 38, thereby enabling to perform cleaning while efficiently sucking the dust and dirt.

That is, under the state where the amount of the dust and dirt accumulated in the dust-collecting unit 23 is equal to or more than a specified amount, the suction force by the electric blower 38 is lowered, and thus the efficiency in cleaning is lowered. Accordingly, in the case where the amount of the dust and dirt in the dust-collecting unit 23 detected by the dust collection amount detection part 25 is equal to or more than a specified amount and where the travel control part 26 makes the vacuum cleaner 11 travel to the dust station 12, the cleaning unit 22 is stopped, thereby enabling to avoid the cleaning under the state where the efficiency in cleaning by the cleaning unit 22 is lowered, and to suppress the waste of the battery capacity in the secondary battery 30.

In the case where the amount of the dust and dirt in the dust-collecting unit 23 detected by the dust collection amount detection part 25 is equal to or more than a specified amount and where the vacuum cleaner 11 is made to travel (temporarily return) to the dust station 12, the cleaning time increases. In this case, the travel control part 26 increases the traveling speed as compared to the normal traveling speed, thereby shortening the traveling time, and thus enabling to suppress increase of the cleaning time.

A user may recognize, as needless operation not as the cleaning operation, the operation in which the travel control part 26 makes the vacuum cleaner 11 travel to the dust station 12 when the amount of the dust and dirt detected by the dust collection amount detection part 25 is equal to or more than a specified amount. Therefore, the indication part 29 notifies a user that the vacuum cleaner 11 is performing necessary and valid operation, thereby enabling to make the user recognize so.

Moreover, since the indication part 29 indicates the notification, the user can see the indication regardless of timing during the indication of the notification, whereby the user scarcely overlooks the indication.

When the cleaning is restarted after the dust and dirt accumulated in the dust-collecting unit 23 is transferred to the dust-collecting container 53 of the dust station 12, the travel control part 26 makes the vacuum cleaner 11 undock from the dust station 12, and makes the vacuum cleaner 11 travel to the position at which the amount of the dust and dirt accumulated in the dust-collecting unit 23 has been determined to be equal to or more than a specified amount. Accordingly, the vacuum cleaner 11 is able to restart the cleaning from the position at which the cleaning has been interrupted temporarily, thereby enabling to mostly prevent an uncleaned area from being left in the cleaning area.

When the travel control part 26 makes the vacuum cleaner 11 travel from the position of the dust station 12 to the position P at which the amount of the dust and dirt accumulated in the dust-collecting unit 23 has been determined to be equal to or more than a specified amount, the cleaning unit 22 is stopped, thereby enabling to suppress the waste of the battery capacity in the secondary battery 30.

In addition, when the travel control part 26 makes the vacuum cleaner 11 travel from the position of the dust station 12 to the position P at which the amount of the dust and dirt accumulated in the dust-collecting unit 23 has been determined to be equal to or more than a specified amount, the travel control part 26 increases the traveling speed as compared to the normal traveling speed, thereby shortening the traveling time and thus enabling to suppress the increase of the cleaning time.

A user may recognize, as needless operation not as the cleaning operation, also the operation in which the travel control part 26 makes the vacuum cleaner 11 travel from position of the dust station 12 to the position P at which the amount of the dust and dirt accumulated in the dust-collecting unit 23 has been determined to be equal to or more than a specified amount. Therefore, the indication part 29 notifies a user that the vacuum cleaner 11 is performing necessary and valid operation, thereby enabling to make the user recognize so.

Moreover, since the indication part 29 indicates the notification, the user can see the indication of the notification regardless of timing during the indication of the notification, whereby the user scarcely overlooks the indication.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

(1) A method for controlling a vacuum cleaner capable of traveling autonomously, the vacuum cleaner including a travel driving part; a cleaning part configured to perform cleaning to remove dust and dirt; a dust-collecting unit configured to accumulate the dust and dirt removed by the cleaning part; dust collection amount detection means configured to detect an amount of the dust and dirt accumulated in the dust-collecting unit; and a travel control part configured to control driving of the travel driving part so as to make the vacuum cleaner travel autonomously, the method including, when the amount of the dust and dirt detected by the dust collection amount detection means is equal to or more than a specified amount while the cleaning part performs the cleaning, the steps of: making the vacuum cleaner travel to a station device including a dust storage part; and making the vacuum cleaner undock from the station device to restart the cleaning, after the dust and dirt accumulated in the dust-collecting unit is transferred to the dust storage part at the station device.

(2) The method for controlling the vacuum cleaner according to (1), the method including the step of making the vacuum cleaner travel to the station device on a basis of a map a cleaning area retained by the vacuum cleaner.

(3) The method for controlling the vacuum cleaner according to (1) or (2), the method including the step of stopping the cleaning part when the amount of the dust and dirt detected by the dust collection amount detection means is equal to or more than the specified amount and when the vacuum cleaner is made to travel to the station device.

(4) The method for controlling the vacuum cleaner according to any one of (1) to (3), the method including the step of increasing a traveling speed as compared to a normal traveling speed, when the amount of the dust and dirt detected by the dust collection amount detection means is equal to or more than the specified amount and when the vacuum cleaner is made to travel to the station device.

(5) The method for controlling the vacuum cleaner according to any one of (1) to (4), the method including the step of issuing a notification when the amount of the dust and dirt detected by the dust collection amount detection means is equal to or more than the specified amount and when the vacuum cleaner is made to travel to the station device.

(6) The method for controlling the vacuum cleaner according to anyone of (1) to (5), the method including, when restarting the cleaning after the dust and dirt accumulated in the dust-collecting unit is transferred to the dust storage part at the station device, the step of making the vacuum cleaner undock from the station device and travel to a position where the amount of the dust and dirt accumulated in the dust-collecting unit has been determined to be equal to or more than the specified amount.

(7) The method for controlling the vacuum cleaner according to (6), the method including the step of making the vacuum cleaner travel to the position where the amount of the dust and dirt accumulated in the dust-collecting unit has been determined to be equal to or more than the specified amount, on a basis of the map retained by the vacuum cleaner.

(8) The method for controlling the vacuum cleaner according to (6), the method including the steps of: storing a feature of the position where the amount of the dust and dirt detected by the dust collection amount detection means has been determined to be equal to or more than the specified amount when the amount of the dust and dirt is equal to or more than the specified amount and when the vacuum cleaner is made to travel to the station device; and making the vacuum cleaner travel to the position where the amount of the dust and dirt accumulated in the dust-collecting unit has been determined to be equal to or more than the specified amount, on a basis of the stored feature.

(9) The method for controlling the vacuum cleaner according to (7) or (8), the method including the step of stopping the cleaning part when making the vacuum cleaner travel from the station device to the position where the amount of the dust and dirt accumulated in the dust-collecting unit has been determined to be equal to or more than the specified amount.

(10) The method for controlling the vacuum cleaner according to any one of (7) to (9), the method including the step of increasing the traveling speed as compared to the normal traveling speed when making the vacuum cleaner travel from the station device to the position where the amount of the dust and dirt accumulated in the dust-collecting unit has been determined to be equal to or more than the specified amount.

(11) The method for controlling the vacuum cleaner according to any one of (7) to (10), the method including the step of issuing a notification when making the vacuum cleaner travel from the station device to the position where the amount of the dust and dirt accumulated in the dust-collecting unit has been determined to be equal to or more than the specified amount.

The invention claimed is:

1. A vacuum cleaning apparatus comprising:

a vacuum cleaner configured to travel autonomously; and a station device including a dust storage part configured to receive and store at least a part of dust and dirt collected and caught by the vacuum cleaner, the vacuum cleaner including:

a travel driving part;

a cleaning part configured to perform cleaning to remove dust and dirt;

a dust-collecting unit configured to accumulate the dust and dirt removed by the cleaning part;

a dust collection amount detector configured to detect an amount of the dust and dirt accumulated in the dust-collecting unit;

a secondary battery; and a travel controller configured to control driving of the travel driving part so as to make the vacuum cleaner autonomously travel, so as to make the vacuum cleaner travel to the station device when the amount of the dust and dirt detected by the dust collection amount detector is equal to or more than a specified amount while the cleaning part performs the cleaning, wherein the travel controller is configured to make the vacuum cleaner undock from the station device to restart the cleaning, after the dust and dirt accumulated in the dust-collecting unit is transferred to the dust storage part at the station device without charging the secondary battery via the station device when a remaining capacity of the secondary battery is sufficient for cleaning after the restart of the cleaning, and the travel controller is configured to make the vacuum cleaner undock from the station to restart the cleaning after the dust and dirt accumulated in the dust-collecting unit is transferred to the dust storage part at the station device and shortage of the secondary battery is charged via the station device when a remaining capacity of the secondary battery is insufficient for cleaning after the restart of the cleaning.

2. The vacuum cleaning apparatus according to claim 1, wherein the vacuum cleaner includes a map retaining part configured to generate or retain a map of a cleaning area, and the travel controller makes the vacuum cleaner travel to the station device on a basis of the map retained by the map retaining part.

3. The vacuum cleaning apparatus according to claim 1, wherein the cleaning part is stopped when the amount of the dust and dirt detected by the dust collection amount detector is equal to or more than the specified amount and when the travel controller makes the vacuum cleaner travel to the station device.

4. The vacuum cleaning apparatus according to claim 1, wherein the travel controller increases a traveling speed as compared to a normal traveling speed, when the amount of the dust and dirt detected by the dust collection amount detector is equal to or more than the specified amount and when the travel controller makes the vacuum cleaner travel to the station device.

5. The vacuum cleaning apparatus according to claim 1, the vacuum cleaning apparatus comprising:

a notification part configured to issue a notification when the amount of the dust and dirt detected by the dust collection amount detector is equal to or more than the specified amount and when the travel controller makes the vacuum cleaner travel to the station device.

6. The vacuum cleaning apparatus according to claim 1, wherein when the cleaning is restarted after the dust and dirt accumulated in the dust-collecting unit is transferred to the dust storage part at the station device, the travel controller makes the vacuum cleaner undock from the station device and travel to a position where the amount of the dust and dirt accumulated in the dust-collecting unit has been determined to be equal to or more than the specified amount.

7. The vacuum cleaning apparatus according to claim 2, wherein the vacuum cleaner includes the map retaining part configured to generate or retain the map of the cleaning area, and the travel controller makes the vacuum cleaner travel to the position where the amount of the dust and dirt accumulated in the dust-collecting unit has been determined to be equal to or more than the specified amount, on a basis of the map retained by the map retaining part.

8. The vacuum cleaning apparatus according to claim 6, the vacuum cleaning apparatus comprising:

a feature storage part configured to store a feature of the position where the amount of the dust and dirt detected by the dust collection amount detector has been determined to be equal to or more than the specified amount when the amount of the dust and dirt is equal to or more than the specified amount and when the travel controller makes the vacuum cleaner travel to the station device, wherein the travel controller makes the vacuum cleaner to the position where the amount of the dust and dirt accumulated in the dust-collecting unit has been determined to be equal to or more than the specified amount, on a basis of the feature stored in the feature storage part.

9. The vacuum cleaning apparatus according to claim 7, wherein the cleaning part is stopped when the travel controller makes the vacuum cleaner travel from the station device to the position where the amount of the dust and dirt accumulated in the dust-collecting unit has been determined to be equal to or more than the specified amount.

10. The vacuum cleaning apparatus according to claim 7, wherein the travel controller increases the traveling speed as compared to the normal traveling speed, when the travel controller makes the vacuum cleaner travel from the station device to the position where the amount of the dust and dirt accumulated in the dust-collecting unit has been determined to be equal to or more than the specified amount.

11. The vacuum cleaning apparatus according to claim 7, the vacuum cleaning apparatus comprising:

a notification part configured to issue a notification when the travel controller makes the vacuum cleaner travel from the station device to the position where the amount of the dust and dirt accumulated in the dust-collecting unit has been determined to he equal to or more than the specified amount.

* * * * *